US005247332A

United States Patent [19]

Taniguchi et al.

[11] Patent Number: 5,247,332

[45] Date of Patent: Sep. 21, 1993

[54] COPYING MACHINE HAVING A ZOOMING FUNCTION

[75] Inventors: Akihiko Taniguchi, Nara; Junichi Kajiwara, Yamatokoriyama; Masanori Mori, Ayama, all of Japan

[73] Assignee: Sharp Kabushiki Kaisha, Osaka, Japan

[21] Appl. No.: 786,801

[22] Filed: Nov. 1, 1991

[30] Foreign Application Priority Data

Nov. 1, 1990 [JP] Japan ..... 2-296215

[51] Int. Cl.[5] ..... G03G 21/00

[52] U.S. Cl. ..... 355/204; 355/218; 355/243

[58] Field of Search ..... 355/243, 233, 218, 204

[56] References Cited

U.S. PATENT DOCUMENTS

| | | | |
|---|---|---|---|
| 4,552,447 | 11/1985 | Sagara et al. | 355/243 X |
| 4,743,944 | 5/1988 | Tomosada et al. | 355/243 X |
| 4,825,250 | 4/1989 | Miyata et al. . | |
| 4,980,814 | 12/1990 | Hosaka et al. | 355/204 X |
| 5,072,259 | 12/1991 | Ikeda | 355/218 |

FOREIGN PATENT DOCUMENTS

| | | |
|---|---|---|
| 3321291 | 12/1983 | Fed. Rep. of Germany . |
| 61-282869 | 12/1986 | Japan . |
| 1-108559 | 4/1989 | Japan . |
| 2-007891 | 1/1990 | Japan . |
| 2-264274 | 10/1990 | Japan . |

*Primary Examiner*—A. T. Grimley
*Assistant Examiner*—Nestor R. Ramirez
*Attorney, Agent, or Firm*—David G. Conlin; Henry D. Pahl, Jr.

[57] ABSTRACT

A copying machine having a zooming function, the copying machine including a first driving motor for scanning an optical reading system, a first control circuit for controlling the first driving motor, a second driving motor for driving an image forming section including a photosensitive body and for feeding copy paper, a second control circuit for controlling the second driving motor, a side eraser control circuit for controlling the side eraser and switches on a light of a corresponding LED in response to the magnification, and control means for outputting a speed control signal in response to the selected magnification to the first control circuit so as to control the scanning speed of the optical reading system, and outputting a control signal in response to the selected magnification to the side eraser circuit, and outputting a driving signal generated from the control signal to the second control circuit so as to control the second driving motor.

5 Claims, 2 Drawing Sheets

COPYING MACHINE HAVING A ZOOMING FUNCTION

BACKGROUND OF THE INVENTION

1. Field of the Invention

The present invention relates to a copying machine, and more particularly to a copying machine having a zooming function wherein an unwanted image is erased by a side eraser equipped with LED heads when a reduction copy mode is selected.

2. Description of the Prior Art

Synchro motors and DC motors are commonly used for driving the copying machine having a zooming function. By controlling the rotating speeds of these motors, a photosensitive drum, a electro static charger located around the photosensitive drum, and a copying process taking place in a development unit and a feeding speed of copy paper are controlled as desired.

Since the rotation of the synchro motor is controlled synchronously with the frequency of a power source, the control of rotation is likely to be inaccurate because of the fluctuating frequencies of the power source. For this reason, a mechanical speed change gear is required, but it results in energy waste because of loss occurring in the power transmission. To compensate for the loss of energy, a large-sized synchro motor must be used, thereby increasing the size of the copying machine, and making the mechanism complicated.

To achieve a small copying machine, it is common practice to use a relatively small DC motor in recent years.

However, a DC motor presents a problem in changing magnification in the copying machines: commonly, magnification is changed by changing a scanning speed of the optical reader system while the copying process is conducted at a constant speed. This requires DC motor for each of the optical system and the copying process. To control the different DC motors, different rotation information is required for generating synchronous control signals. The control system becomes complicated, and an expensive microcomputer having a high quality is needed. As a result, the total cost of the copying machine will be high.

SUMMARY OF THE INVENTION

The copying machine of this invention, which overcomes the above-discussed and numerous other disadvantages and deficiencies of the prior art, wherein the copying machine includes a side eraser for erasing an unwanted image area on a photosensitive body when a reduction copy mode is selected, comprises a first driving motor for scanning an optical reading system, a first control circuit for controlling the first driving motor, a second driving motor for driving an image forming section including a photosensitive body and for feeding copy paper, a second control circuit for controlling the second driving motor, a side eraser control circuit for controlling the side eraser and switches on a light of a corresponding LED in response to the magnification, and control means for outputting a speed control signal in response to the selected magnification to the first control circuit so as to control the scanning speed of the optical reading system, and outputting a control signal in response to the selected magnification to the side eraser circuit, and outputting a driving signal generated from the control signal to the second control circuit so as to control the second driving motor.

In a preferred embodiment, the second motor is controlled by a one-chip CPU.

In a preferred embodiment, the second motor is connected to a tachometer generator.

Thus, the invention described herein makes possible the objectives of (1) providing a copying machine which controls a side eraser in accordance with an erasing information based on an intended magnification, drives an image forming section, and controls a driving motor which feeds copy paper, and (2) providing a copying machine which includes a driving motor and an optical reading system synchronized, based on the magnification information.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
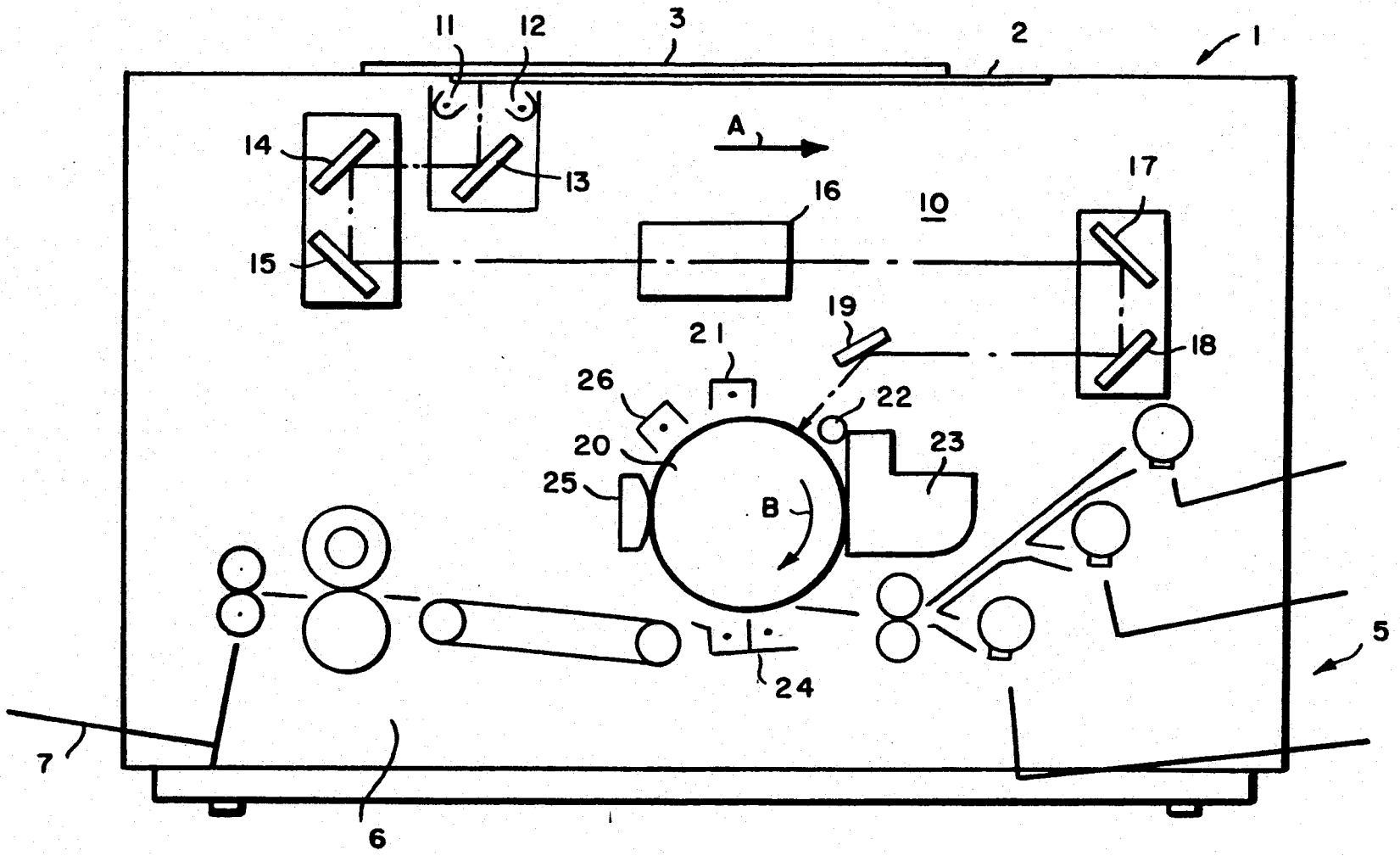
FIG. 1 is a sectional front view showing a schematic structure of a copying machine of the present invention.

Referring to FIG. 1, a copying machine 1 includes a paper platen 3, made of transparent glass, on which a copy paper 2 is placed. The paper platen 3 is located on the upper end of the main body thereof. An optical system 10, which will be described below, is located under the paper platen 3.

Under the paper platen 3, a pair of light sources 11 and 12 which radiate a light on the copy paper 2 are located so as to move in the direction of arrow A. A light reflected from the copy paper 2 first reflects on a first mirror 13 in the opposite direction of arrow A, and then it is reflected in the direction of arrow A on a second mirror 14 and a third mirror 15.

The reflected light is introduced to a fourth mirror 17 and a fifth mirror 18 via a lens unit 16 and then it is reflected in the opposite direction of arrow A with the fifth mirror 18 and then it is exposed to a photosensitive drum 20 located at a central part under the main body of the copying machine 1 with a reflection mirror 19 located in the way of the light path.

Figure 2:
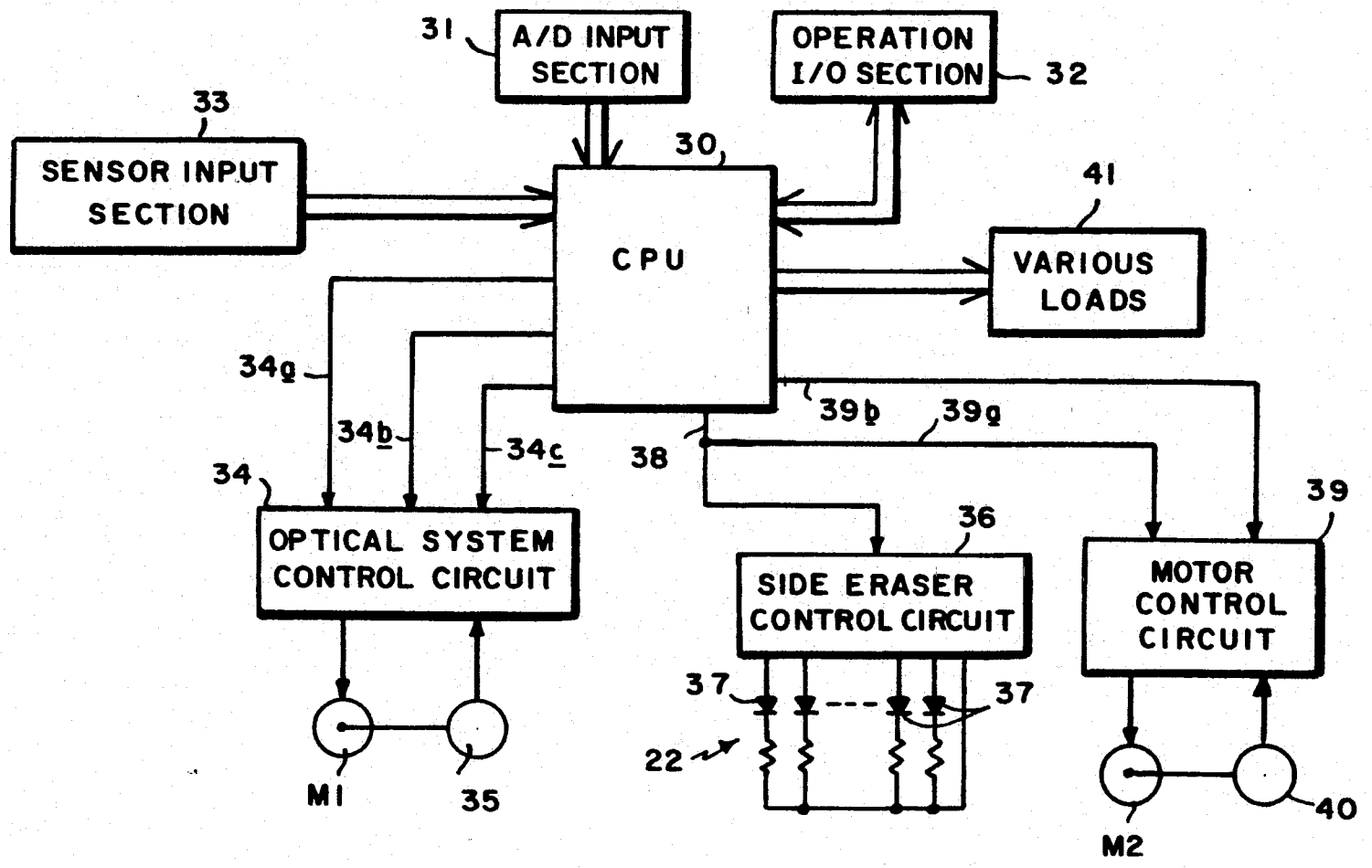
FIG. 2 is a block diagram showing the control system of FIG. 1.

In addition, the optical system 10 except the reflection mirror 19 is driven by a DC motor M1 (FIG. 2).

The structure around the photosensitive drum 20 will be described below:

The photosensitive drum 20 rotates in the direction of arrow B, and an electro static charger 21 is located outside the photosensitive drum 20 toward an upstream side of an exposure region in the direction of rotation thereof. The electro static charger 21 uniformly charges the surface of the photosensitive drum 20 prior to exposure. In this way, an electrostatic latent image is formed on the exposure region. A side eraser 22, a developing unit 23, a transfer charger 24, a cleaner 25 and an electro-discharger 26 are respectively located around the photosensitive drum 20 on a downstream side of the electro static charger 21.

The side eraser 22 includes n pieces of the LEDs in parallel with the direction of the axis of the photosensitive drum 20, and when a reduction copy mode is selected, it erases an unwanted image region.

The developing unit 23 provides a toner to the electrostatic latent image which is formed as described above and forms a toner image on the surface of the photosensitive drum 20. The tone image is transferred to the copy paper at the position of the transfer charger 24. The copy paper is fed to the position of the transfer charger 24 by a paper feeding system 5 located at a right-hand lower part of the main body of the copying machine 1. This feeding operation is synchronized with the rotation of the photosensitive drum 20.

The copy paper transferred to the toner image by the transfer charger 24 is fed to a fixing unit 6 located on a left-hand side of the photosensitive drum 20 to fix the image. After the fixing process is finished, the copy paper is discharged to the copy receiving tray 7.

After the fixing process is finished, part of the toner which has not contributed to the transfer is likely to remain on the photosensitive drum 20. The cleaner 25 clears and scrapes away the residual toner. The remaining charge also remains on the surface of the photosensitive drum 20, but the electro-discharger 26 removes this charge.

Referring to FIG. 2, the structure of a control system of the present invention will be described:

A CPU 30 includes a one-chip microcomputer and controls all the operations of the copying machine. Various analog information which is converted into digital information is input to the CPU 30 from an A/D input section 31. An operation input/output section 32 is located on an operation panel of the main body of the copying machine 1 is connected to the CPU 30, and various information such as the setting of copy quantity and copy magnification is input to the CPU 30 via the operation input/output section 32. This input information is indicated at an indicating section of the operation input/output section 32.

Detecting signals from various sensors which are located at predetermined positions in the main body of the copying machine 1 by the sensor input section 33, that is, ON/OFF information (e.g. jam information) is input into the CPU 30, and according to this input information, various loads (driving system) 41 are controlled by sequential control.

The CPU 30 outputs a synchronous pulse **34*a* to an optical system control circuit 34 according to the input information from the operation input/output section 32. That is, a pulse output, which is needed to scan the optical system 10 at a speed set in response to the magnification which is set by the operation input/output section 32, is given to the optical system control circuit 34. Then, the optical system control circuit 34 controls the rotations of the motor M1 to drive the optical system, and scan the optical system 10 at a speed set in response to the magnification. The motor M1 is connected to a rotation detecting means 35 such as a tachometer generator, and the rotation information detected from the rotation detecting means 35 is given to the optical system control circuit 34 as a feedback signal whereby the motor M1** rotates smoothly at a constant speed.

In addition, in the optical system control circuit 34, a command signal **34*b* for driving and stopping the motor M1, and a rotational direction switching signal 34*c* for moving the optical system 10 in the scanning direction or the opposite direction, are input from the CPU 30**.

A side eraser control circuit 36 for controlling the drive of the side eraser 22 is connected to the CPU 30. The side eraser control circuit 36 controls the switching of the LED heads including n pieces of LEDs 37 located parallel to the direction of the axis of the photosensitive drum 20 according to the information of the copy magnification from the operation input/output section 32 via CPU 30. More specifically, when a reduction copy is selected, and a definite reduction rate is given to the CPU 30 from the operation input/output section 32, the CPU 30 outputs a side erase clock pulse 38, which is synchronous with the synchronous pulse **34*a* as a signal to erase the unwanted image area, to the side eraser control circuit 36, and the side eraser control circuit 36** controls the switching of the LED heads.

This switching control is operated as follows:

Except the reduction copy, that is, when the same size copy or an enlargement copy is performed, it is not necessary to perform the side eraser, and in these cases, a duty ratio is set to 10% PWM output but none of the n pieces of LEDs 37 fires at this duty ratio of 10% PWM output.

When the reduction copy is performed, the duty ratio is set to 20% PWM output when the reduction rate is smallest, and in this case, the LED 37 in the corresponding region is set to switch on the light. The duty ratio of the PWM output is set so as to increase as the reduction ratio increases, and when the largest reduction ratio is selected, all of the n pieces of LED heads are set to switch on the light.

This PWM output is D/A converted by D/A converting means (not shown) such as a CR 2-steps filter in the input section of the side eraser control circuit 36, and is respectively input to the input terminals of comparison amplifiers (not shown) which are respectively connected to the n pieces of LEDs 37 as an analog D.C. signal and a parallel signal The comparison amplifiers are given a voltage value which does not switch on all the comparison amplifiers when the PWM output with the duty ratio 10% as a reference voltage level, but they switch on if the PWM output is over 10%, and then they are set to switch on the light of the corresponding LED 37.

This signal process generates a side erase clock pulse 38 as a direct current signal having a constant cycle. Therefore the signal can be used as a driving command signal of the DC motors. In this embodiment, a driving signal **39*a* obtained from the side erase clock pulse 38 is given to a motor M2 via a motor control circuit 39** for driving, thereby facilitating the driving of the copying section and the feeding of copy paper.

The side eraser 22 and the motor M2 are driven in synchronization when the reduction copy is performed. This means that the optical system 10, the copying section, and the feeding of the copy paper are synchronized. In this way, the same information can be used to control the two motors M1 and M2, thereby reducing the size of the control system, and simplifying the structure including the circuit structure. This eliminates the necessity of employing an expensive CPU units.

In addition, a motor driving command signal **39*b* for driving and stopping the motor M2 is given to the motor M2 from the CPU 30, and the motor M2 is rotated when the rotation output becomes "H" (=high level), and the speed of the motor M2 is adjusted by the driving signal 39*a* which is given when the reduction copy is performed. On the other hand, the rotation of the motor M2 is controlled only by the motor driving command signal 39*b*** when the same size copy or the enlargement copy is performed.

The motor M2 is connected to a rotation detecting means 40 such as a tachometer generator, and the information of the motor M1 detected by the rotation detecting means 40 is given to a motor control circuit 39 for driving as a feedback signal, whereby a motor M2 is rotated smoothly without causing irregular rotation.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A copying machine having a zooming function which copies after erasing an unwanted image area on a photosensitive body by a side eraser including LED heads when a reduction copy mode is selected, each of the LED heads having plurality of LEDs, the copying machine comprising:

a first driving motor for driving an optical reading system during a scanning operation;

a first control circuit for controlling the first driving motor;

a second driving motor for driving an image forming section including a photosensitive body and for driving a copy paper feeding means;

a second control circuit for controlling the second driving motor;

a side eraser control circuit for controlling the side eraser to switch on corresponding LEDs in response to a selected magnification based on the selected reduction copy mode; and control means for, in response to the selected magnification, outputting a first control signal to the first control circuit, and outputting a second control signal to the side eraser and the second control circuit, the first control circuit controlling the scanning speed of the optical reading system based on the first control signal, and the side eraser control circuit controlling the side eraser and the second control circuit controlling the second driving motor based on the second control signal.

2. A copying machine according to claim 1, wherein the first driving motor, the side eraser and the second driving motor are controlled by a one-chip CPU.

3. A copying machine according to claim 1, wherein the first driving motor and the second driving motor are connected to tachometer generators, respectively.

4. A copying machine according to claim 1, wherein the second control signal is synchronized with the first control signal.

5. A copying machine according to claim 1, wherein the driving of the optical reading system and the driving of the image forming section are synchronized.

* * * * *